US006953063B2

(12) United States Patent
Krumm et al.

(10) Patent No.: US 6,953,063 B2
(45) Date of Patent: Oct. 11, 2005

(54) METHOD FOR OPERATING A WEAVING AND SHEDDING MACHINE

(75) Inventors: Valentin Krumm, Hergensweiler (DE); Dietmar Von Zwehl, Achberg (DE); Michael Lehmann, Lindau (DE); Dieter Mayer, Wangen (DE)

(73) Assignee: Lindauer Dornier Gesellschaft mbH, Lindau (DE)

( * ) Notice: Subject to any disclaimer, the term of this patent is extended or adjusted under 35 U.S.C. 154(b) by 301 days.

(21) Appl. No.: 10/415,385

(22) PCT Filed: Oct. 6, 2001

(86) PCT No.: PCT/DE01/03840

§ 371 (c)(1),
(2), (4) Date: Apr. 25, 2003

(87) PCT Pub. No.: WO02/34982

PCT Pub. Date: May 2, 2002

(65) Prior Publication Data

US 2004/0031533 A1 Feb. 19, 2004

(30) Foreign Application Priority Data

Oct. 26, 2000 (DE) ..... 100 53 079

(51) Int. Cl.[7] ..... D03D 49/06
(52) U.S. Cl. ..... 139/1 E
(58) Field of Search ..... 139/1 R, 99, 116.2, 139/1 E, 337; 700/140

(56) References Cited

U.S. PATENT DOCUMENTS

| | | | | |
|---|---|---|---|---|
| 3,680,602 A | | 8/1972 | Hindle et al. | |
| 4,364,002 A | * | 12/1982 | Suzuki et al. | 318/467 |
| 4,669,510 A | * | 6/1987 | Speich | 139/1 E |
| 5,335,698 A | | 8/1994 | Berktold et al. | |
| 5,404,916 A | * | 4/1995 | Mueller et al. | 139/116.2 |

FOREIGN PATENT DOCUMENTS

| | | |
|---|---|---|
| EP | 0629725 | 12/1994 |
| EP | 0761856 | 3/1997 |
| EP | 0839939 | 5/1998 |
| EP | 0893525 | 1/1999 |

* cited by examiner

*Primary Examiner*—John Calvert
*Assistant Examiner*—Andrew W. Sutton
(74) *Attorney, Agent, or Firm*—W. F. Fasse; W. G. Fasse

(57) ABSTRACT

A method of operating a weaving machine and a shedding machine aims, to achieve so-called soft starts and soft stops, in particular, of the shedding machine. The weaving machine is equipped with an electromotive main drive and the shedding machine is equipped with an electromotive auxiliary drive. In the method the shedding machine is started at a time point (t1) that lies before the starting time point of the weaving machine, and, upon a triggered interruption of the weaving process, a shedding machine comes to the standstill at a time point (t5) that lies after the standstill time point (t4) of the weaving machine.

8 Claims, 1 Drawing Sheet

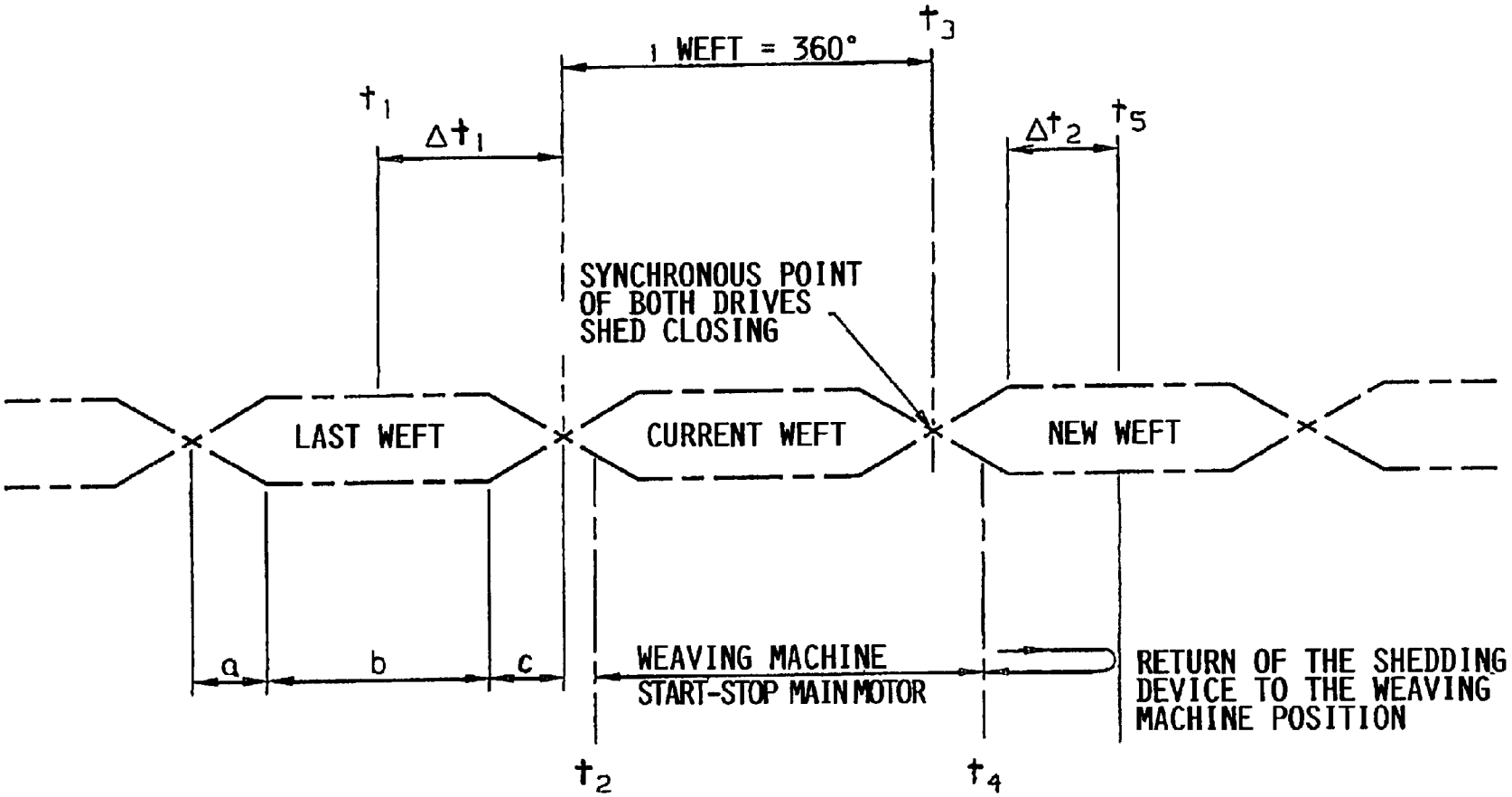
1 WEFT = 360°
$t_1$
$\Delta t_1$
$t_3$
$\Delta t_2$
$t_5$
LAST WEFT
CURRENT WEFT
NEW WEFT
SYNCHRONOUS POINT OF BOTH DRIVES SHED CLOSING
a
b
c
$t_2$
$t_4$
WEAVING MACHINE START-STOP MAIN MOTOR
RETURN OF THE SHEDDING DEVICE TO THE WEAVING MACHINE POSITION

METHOD FOR OPERATING A WEAVING AND SHEDDING MACHINE

FIELD OF INVENTION

The invention relates to a method for operating a weaving and shedding machine.

BACKGROUND INFORMATION

A drive arrangement is known from the EP 0,893,525 A1, wherein this drive arrangement consists of a weaving machine, which possesses a drive motor as a main motor, and of a shedding machine with a drive motor as an auxiliary motor, as well as a control device.

The control device is connected in a signal transmitting manner on the one hand with the main motor of the weaving machine, and is connected in a signal transmitting manner on the other hand with the drive of the shedding machine embodied as an auxiliary motor. A regulating unit integrated in the control device pursues a regulation strategy, whereby on the one hand the weaving machine and the shedding machine are operated essentially synchronously at their start up, and on the other hand the shedding machine is operated with a predetermined rotational speed fluctuation during the weaving operation, whereby this rotational speed fluctuation lies within the rotational speed tolerance of the weaving machine.

The previously known drive arrangement has the disadvantage, due to the synchronous operating manner of both drives, that a beating-up of the weaving reed against the binding or interlacing point of the woven fabric takes place per revolution of the weaving machine main shaft during the starting phase. In this case, an undesired compressing or compacting of the woven fabric without a weft thread insertion is practiced, for example during five revolutions of the weaving machine main shaft, identical to five weaving cycles or five beat-up strokes of the weaving reed against the interlacing point of the woven fabric. Moreover, the beating-up of the weaving reed without weft thread insertion leads to a so-called micro-roughening of the weft and warp threads at the interlacing point of the woven fabric. For example during the dyeing of the produced woven fabric, the micro-roughening retroactively leads to an apparent weaving fault or defect, because comparatively more dye will be taken up both by the compressed or compacted woven fabric section as well as by the roughened weft and warp threads, than by the remaining woven fabric.

A grave disadvantage of the previously known solution is that the synchronous manner of operating the drives in the starting phase but also in the braking phase of the weaving and shedding machine leads to an increased loading or stressing of the machine elements and drive elements in comparison to the weaving process. The increased loading or stressing, of which the cause lies in the prescribed starting or run-up behavior of the weaving and shedding machine, as a consequence requires a corresponding design of the electromotive drives with respect to power consumption, rotational moment or torque, etc., and a corresponding dimensioning of the applicable machine parts and elements.

SUMMARY OF INVENTION

It is the object of the invention, to optimize the electromotive driving torques and braking torques required in the starting and braking phase of the weaving and shedding machine while reducing the mechanical stress or loading of machine elements of the shedding and weaving machine, and while preventing starting marks in the woven fabric, and based thereon, to achieve so-called soft starts and soft stops, in particular, of the shedding machine.

According to the invention, the object is achieved in a method of operating a weaving and a shedding machine with the following special features.

A first essential feature according to the invention is that the shedding machine is started in a freely programmable manner within a time window $\Delta t1$ before the weaving machine, and that the weaving machine is only started after the running-out or expiration of the time window $\Delta t1$, at a later time point $t2$. Connected therewith is the advantage that a lower drive moment or torque of the electromotive drives, in comparison to the prior art, is required in the starting phase of the weaving and shedding machine. A further decisive advantage is that the weaving reed of the weaving machine carries out no reed beat-ups against the beat-up edge of the woven fabric or against the interlacing point of the woven fabric in the starting phase of the shedding machine, and thereby so-called starting marks, as caused by reed beat-ups without weft threads, are avoided.

A second essential characteristic feature according to the invention exists in that, after a prescribed progress or execution of the starting processes, the shedding and weaving machines are operated approximately synchronously at a time point $t3$. This means that, in a shedding machine embodied as a heald or dobby weaving machine or a jacquard weaving machine, the run-up (starting phase) at first can be carried out without movement of the shedding means, and the pattern-controlled movement of the shedding means is added-on beginning only in the phase of the synchronous operating manner of both machines. Thus, in the starting phase of the heald or dobby machine and the jacquard machine, only the masses of the shedding machines by themselves are accelerated, while the shedding means in the weaving machine preferably are located in a shed open position.

A third characteristic feature exists in that the synchronous operating manner of the weaving and shedding machine is terminated in connection with a signal detecting the operational interference or malfunction of the weaving and/or shedding machine. Thereupon, the braking process is initiated for both machines, and namely by a fourth essential characteristic feature according to the invention, which consists in that both machines come to the standstill at different time points after the initiation of the braking process, whereby the shedding machine comes to the standstill according to the invention at a freely programmable time point within a time window $\Delta t2$ after the standstill time point $t4$ of the weaving machine. In this manner it can be provided according to the invention, to operate the drives in the manner of a generator as of their braking time point until the standstill time point, while these function in the manner of a motor in the starting and synchronous running phase. Connected with the operating manner as a generator, is the advantage that the clutch-brake combinations used in weaving machines can be omitted or avoided. The kinetic energy of the weaving and shedding machine is thus not nullified essentially through clutch-brake combinations, but rather is converted into useable energy, for example being fed back into the power grid.

Further embodiment features of the invention and advantageous effects connected therewith arise from the dependent claims.

In the following, the invention is described in further detail in an example embodiment.

BRIEF DESCRIPTION OF THE DRAWINGS

In the schematic illustration, also see the FIGURE, the operating course or sequence, according to the invention, of a weaving and shedding machine is illustrated in connection with the loom shed formation carried out by the shedding machine, whereby the weaving machine possesses an electromotive drive as a main drive and the shedding machine possesses an electromotive drive as an auxiliary drive.

DETAILED DESCRIPTION OF A PREFERRED EXAMPLE EMBODIMENT OF THE INVENTION

As shown on the left side in the schematic illustration, as is generally known, the process for forming a loom shed for the purpose of the picking or insertion of at least one weft thread and for the purpose of interlacing or binding-in the at least one weft thread, consists of:

a) the opening of the loom shed, b) the shed standstill (here the at least one weft thread is inserted into the loom shed) and c) the closing of the loom shed.

As already described above, according to the prior art, the starting process of both machines is carried out synchronously, independently of whether the weaving machine and the shedding machine are started with a common electromotive drive or with respectively mutually independent electromotive drives. The weaving and machine technological disadvantages that arise thereby are known.

The known solution to operate the weaving machine with an electromotive main drive and the shedding machine with an electromotive auxiliary drive offers the possibility according to the invention, to start the shedding machine before the weaving machine. In the schematic illustration, the starting time point t1 of the shedding machine is set according to the invention so that the shedding machine is started before the starting time point t2 of the weaving machine. In this context, the time point t1 of the start of the shedding machine can be freely programmably selected within the time window Δt1. The start of the shedding machine could lie, for example, 60 ms before the start of the weaving machine. The time window Δt1 corresponds to the present example embodiment Δt1=c+b/2. Stated differently, Δt1 corresponds to approximately 180 rotational angle degrees of the weaving machine main shaft, if a corresponds to approximately 90, b corresponds to approximately 180, and c corresponds to approximately 90 rotational angle degrees of the weaving machine main shaft.

The schematic illustration further shows that the weaving machine is started after completion or expiration of the time window Δt1, and namely at a time point t2, which is different from t1. It is important in this regard, that the time points t1 and t2 to be programmed never may be identical, but rather must lie so far apart from one another, that a synchronous operating manner between the shedding machine and the weaving machine exists only upon a shed closing that takes place after the start of the shedding machine and the weaving machine, namely at the time point t3.

The synchronous operating manner of both machines is terminated upon or in connection with an electrical signal detecting an operating interference or malfunction in the weaving or shedding machine, for example upon or in connection with a signal detecting a weft thread break. Thereupon it is provided according to the invention, that the shedding machine comes to a standstill at a time point t5 that is freely programmable within a time window Δt2 and that is after the standstill time point t4 of the weaving machine. With reference to the weaving machine main shaft, the later standstill corresponds to, for example, 180 rotational angle degrees of the weaving machine main shaft after its standstill. For the renewed start, for example after the weft thread break is removed or cleared, the shedding machine is brought into the starting position, which corresponds to the time point t1. Thereby, the shedding machine is once again situated in a position which enables the inventive operating manner of the shedding and weaving machine.

In comparison to the prior art, the inventive operating manner leads to the above mentioned quality improvement in the woven goods, namely the most substantial or extensive avoidance of starting marks, because the shedding machine starts independently of the start of the weaving machine. Thus, no reed beat-ups are realized outside of the synchronization of the weaving machine and the shedding machine.

It is further advantageous, that the weaving machine always starts with the same mass conditions, that is to say the binding or weaving, or respectively the lifting or removal of the jacquard machine has no influence on the run-up behavior of the weaving machine.

The independence of the electromotive drives of the weaving and shedding machine makes it possible in an advantageous manner to vary the shed closing, weft pick for weft pick, during the running operation of the machine, whereby the quantity of weft thread waste can be reduced.

Furthermore, with the separated arrangement of the weaving machine drive and the shedding machine drive, the possibility is opened, for jacquard machines of simple construction type, which have no eccentric controlled loom shed formation, but rather a crank drive, to realize a longer shed standstill by means of rotational speed variation of the electromotive drive, which is advantageous especially for weaving machines with mechanical weft thread insertion means (grippers).

What is claimed is:

1. Method for operating a weaving and shedding machine, whereby the weaving machine is equipped with an electromotive main drive and the shedding machine is equipped with an electromotive auxiliary drive, wherein the electromotive main drive and the electromotive auxiliary drive is actuated in a signal transmitting manner with a control device, wherein the weaving machine and the shedding machine is brought from the standstill to a prescribed rotational speed, and wherein, upon an occurring interference, the weaving machine and the shedding machine are shifted into the standstill by braking means, characterized in:

that the shedding machine is started within a time window Δt1 before the weaving machine, that the weaving machine is started after expiration of the time window Δt1 at a time point t2 lying outside of the time window Δt1, that the shedding machine and the weaving machine, after their starting process, are operated approximately synchronously as of a fixable time point t3, that the synchronous operating manner of the weaving and shedding machine is terminated upon an electrical signal detecting an operating interference, and that thereupon the braking process for the weaving and shedding machine is initiated in such a manner, that both machines come to the standstill at different time points.

2. Method according to claim 1, characterized in that the starting time point of the shedding machine is freely programmable within the time window Δt1.

3. Method according to claim 1, characterized in that the starting time point t2 of the weaving machine lies before the synchronization time point t3 of the shedding and weaving machine.

4. Method according to claim 1, characterized in that the weaving machine comes to the standstill at a time point t4, which lies before the standstill time point t5 of the shedding machine.

5. Method according to claim 4, characterized in that the standstill time point t4 of the weaving machine lies before the maximum opening of a loom shed for a weft thread insertion.

6. Method according to claim 1, characterized in that the standstill time point t5 of the shedding machine is freely programmable within a time window Δt2.

7. Method according to claim 1, characterized in that the weaving machine and the shedding machine is driven in the manner of a generator as of their braking time point until their standstill time point.

8. Drive arrangement for carrying out the method according to claim 1, characterized in that the shedding machine is a heald shaft or dobby machine or a jacquard machine.

* * * * *